United States Patent [19]

Pospelov et al.

[11] 4,280,165

[45] Jul. 21, 1981

[54] DEVICE FOR MEASURING ANGULAR POSITION OF A GEAR IN A DIGITAL IGNITION SYSTEM OF AN INTERNAL COMBUSTION ENGINE

[76] Inventors: Boris S. Pospelov, ulitsa Banykina, 6, kv. 116; Alexandr F. Bendersky, Moskovsky prospekt, 33, kv. 265, both of Tolyatti Kuibyshevskoi oblasti; Jury A. Kolesov, ulitsa Gilyarovskogo, 54, kv. 3, Moscow; Yakov N. Nefediev, Sirenevy bulvar, 12, kv. 22, Moscow; Mikhail I. Levkovich, ulitsa 1812 goda, 8, kv. 56, Moscow; Eduard N. Asinovsky, ulitsa Koptevskaya, 89, kv. 24, Moscow, all of U.S.S.R.

[21] Appl. No.: 32,906

[22] Filed: Apr. 24, 1979

[51] Int. Cl.[3] ..... H01H 47/00

[52] U.S. Cl. ..... 361/236; 324/173

[58] Field of Search ..... 361/242, 236, 239; 324/173, 174, 179

[56] References Cited

U.S. PATENT DOCUMENTS

| | | | |
|---|---|---|---|
| 3,281,593 | 10/1966 | Mendelsohn | 324/179 X |
| 3,626,247 | 12/1971 | Morse | 361/242 X |
| 3,819,268 | 6/1974 | Johnson | 324/173 X |
| 3,868,570 | 2/1975 | Kopera, Jr. | 324/174 X |
| 4,001,687 | 1/1977 | Sorkin et al. | 324/173 |
| 4,115,831 | 9/1978 | Minakuchi | 361/236 |
| 4,121,112 | 10/1978 | Hartig | 324/173 X |

*Primary Examiner*—J. D. Miller
*Assistant Examiner*—L. C. Schroeder
*Attorney, Agent, or Firm*—McAulay, Fields, Fisher, Goldstein & Nissen

[57] ABSTRACT

The invention relates to a device for measuring the angular position of a gear in a digital ignition system of an internal combustion engine, wherein an origin sensor responsive to the passage by of a pre-set tooth of a gear, is connected to one of inputs of a pulse former having a second input to which an output of a rectifier and filter circuit is connected; and an input of the rectifier and filter circuit is coupled to the output of an angle pulse sensor.

1 Claim, 5 Drawing Figures

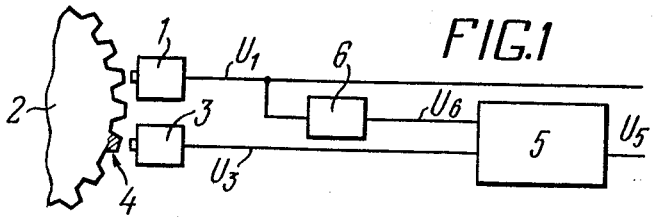
FIG.1
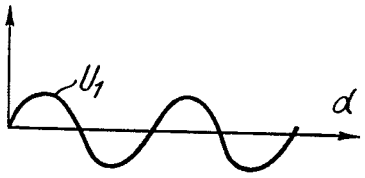
FIG.2
FIG.3
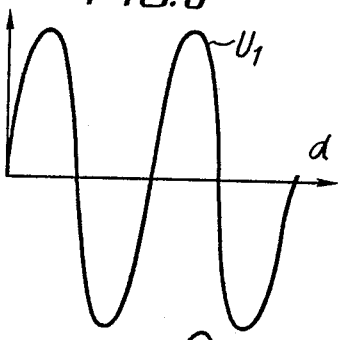
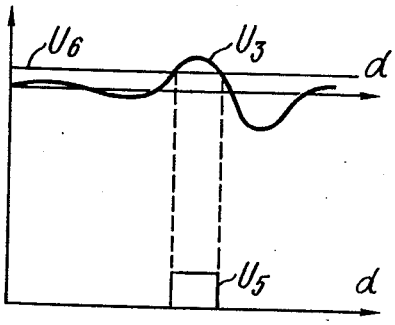
FIG.4
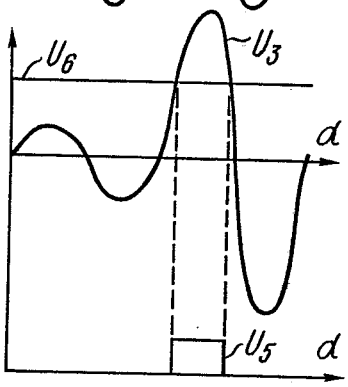
FIG.5

DEVICE FOR MEASURING ANGULAR POSITION OF A GEAR IN A DIGITAL IGNITION SYSTEM OF AN INTERNAL COMBUSTION ENGINE

The invention relates to control devices for ignition systems of internal combustion engines, and in particular, to devices for measuring the angular position of a gear in a digital ignition system of an internal combustion engine.

There is a recent trend to use, in internal combustion engines, ignition systems receiving information on the position of the crankshaft not from a distributor, but rather from a gear which is directly fixed to the crankshaft. The gear may be a flywheel gear or it may comprise a special toothed plate. Devices for measuring the angular position of rotary shafts should be reliable in operation within a broad speed range.

Known in the art are devices for measuring the angular position of a crankshaft in an internal combustion engine, comprising an oscillator-type sensor producing a signal which represents a relatively linear function of the angle between adjacent gear teeth. Sophisticated analog-code converters should be used for employment of such measuring devices in digital ignition systems.

Known in the art are devices for measuring angular position of a gear in a digital ignition system of an internal combustion engine, comprising origin and angle pulse sensors connected to inputs of a pulse former, and a rectifier and filter circuit (cf. FRG Pat. No. 1,539,205, Cl. 46 k, 3/08, 1973).

The disadvantage of such ignition systems resides in false actuations of the pulse former at a high rotary speed, hence a narrow range of the rotary speed of an engine that can be measured.

It is an object of the invention to eliminate the above disadvantages.

Another object of the invention is to provide a device for measuring angular position of a gear in a digital ignition system of an internal combustion engine, ensuring an enlargement of the rotary speed range of the internal combustion engine.

This invention is directed to a device for measuring angular position of a gear in a digital ignition system of an internal combustion engine, comprising an origin sensor responsive to the passage by of a pre-set tooth of the gear, coupled to a first input of a pulse former, a rectifier and filter circuit having an input connected to a second input of the pulse former, an angle pulse sensor, and an input of the rectifier and filter circuit coupled to an output of the angle pulse sensor.

This coupling enables the pulse former in the control of the threshold of the converter. Thus, with an increase in the engine speed, the amplitude of a useful signal grows together with the amplitude of a noise resulting from a small distance from the flywheel teeth to the origin sensor, balancing holes and other factors. Concurrently with the increase in the amplitude of useful signal, the threshold of the origin sensor and pulse former increases thus enlarging the range of measured speed and improving the noise immunity of the measuring device.

The invention will now be described with reference to the accompanying drawings illustrating the preferred embodiment, in which:

FIG. 1 shows a block-diagram of the device for measuring angular position of a gear in a digital ignition system for an internal combustion engine;

FIGS. 2 and 3 show voltage curves for an angle pulse sensor at high and low rotary speed of the gear;

FIGS. 4 and 5 show voltage curves at the origin sensor and at the output of the pulse former at high and low rotary speed of the gear.

A device for measuring angular position of a gear comprises an angle pulse sensor 1 (FIG. 1) responsive to the passage by of teeth of a gear 2, an origin sensor 3 responsive to the passage by of a pre-set tooth 4 of the gear 2, and a pulse former 5.

The angle pulse former 1 is connected to an input of the pulse former 5 via a rectifier and filter circuit 6, and the origin sensor 3 is directly connected to another (inverted) input of the pulse former 5.

The device for measuring angular position of a gear in a digital ignition system of an internal combustion engine functions in the following manner. During rotation of the gear 2, a voltage $U_1$ (FIGS. 2, 3) appears at the output of the angle pulse sensor 1, and a voltage $U_3$ appears at the output of the origin sensor 3 (FIGS. 4,5), which contains, in addition, to the main signal caused by the passage by the origin sensor 3 of the pre-set tooth 4 (FIG. 1), also a noise signal.

The voltage $U_1$ (FIGS. 2,3) is fed, via the rectifier and filter circuit 6 (FIG. 1), to the input of the pulse former 5 in the form of a voltage $U_6$ (FIGS. 4, 5) used as a negative reference voltage. The pulse former 5 (FIG. 1) is responsive to the difference of the input signals $U_3$ and $U_6$ (FIGS. 4,5). With an increase in the rotary speed, the output voltages $U_1$ (FIGS. 2, 3) and $U_3$ (FIGS. 4, 5) of the sensors 1,3 (FIG. 1) grow linearly.

Ignoring losses in the rectifier and filter circuit 2, it may be assumed that the voltage $U_6$ (FIGS. 4, 5) fed to the input of the pulse former 5 (FIG. 1) also grows proportionally with the voltage $U_1$ (FIGS. 2, 3). The ratio of amplitudes of voltages from these sensors 1,3 (FIG. 1) remains unchanged and does not depend on the rotary speed of the gear 2. If the parameters of the sensors 1,3 and their initial setting are selected in such a way that the amplitude of the signal fed to the input of the pulse former 5 via the rectifier and filter circuit 6 is greater than the noise amplitude and smaller than the useful signal amplitude (origin pulse) fed from the sensor 3, the pulse former 5 responsive to the difference of the input signals (voltages $U_3$, $U_6$) will operate only when caused to do so by the origin pulse upon the passage of the tooth 4 of the gear 2 by the sensor 3 independent on the ratio of the signal amplitude to the amplitude of the noise signal.

As the angle pulse sensor 1 is coupled to the input of the pulse former 5 via the rectifier and filter circuit 6 the possibility of false actuation of the pulse former is eliminated, and the range of rotary speed of an engine having the digital ignition system is enlarged.

We claim

1. A device for measuring angular position of a gear in a digital ignition system of an internal combustion engine, comprising: an origin sensor responsive to the passage by of a pre-set tooth of the gear; a pulse former having a first input connected to said origin sensor; a rectifier and filter circuit having an output connected to a second input of said pulse former; an angle pulse sensor having an output coupled to the input of said rectifier and filter circuit.

* * * * *